US005502426A

United States Patent [19]

Blanchard et al.

[11] Patent Number: 5,502,426

[45] Date of Patent: Mar. 26, 1996

[54] PROTECTION SWITCH DEVICE

[75] Inventors: Christian Blanchard, Rueil Malmaison; Michel Lauraire, Saint Maur Des Fosses; Didier Vigouroux, Jouy-Le-Moutier, all of France

[73] Assignee: Schneider Electric SA, Boulogne-Billancourt, France

[21] Appl. No.: 254,896

[22] Filed: Jun. 6, 1994

[30] Foreign Application Priority Data

Jun. 7, 1993 [FR] France ..... 93 06968

[51] Int. Cl.[6] ..... H01H 67/02

[52] U.S. Cl. ..... 335/132; 335/172

[58] Field of Search ..... 335/167–176, 335/131–132, 202, 23–25, 35, 185–190

[56] References Cited

U.S. PATENT DOCUMENTS

| | | | |
|---|---|---|---|
| 4,973,929 | 11/1990 | Duchemin | 335/132 |
| 5,012,215 | 4/1991 | Floc'h | 335/132 |
| 5,300,906 | 4/1994 | Blanchard et al. | 335/132 |

FOREIGN PATENT DOCUMENTS

| | | |
|---|---|---|
| 0237607 | 9/1987 | European Pat. Off. . |
| 0366519 | 2/1990 | European Pat. Off. . |
| 1464396 | 12/1966 | France . |
| 4123563A1 | 1/1992 | Germany . |
| 1355035 | 5/1974 | United Kingdom . |

*Primary Examiner*—Lincoln Donovan
*Attorney, Agent, or Firm*—Oblon, Spivak, McClelland, Maier & Neustadt

[57] ABSTRACT

A protection switch device has power poles whose mobile contacts are carried by a contact-holder, a magnetically and/or thermally tripped protection system to detect overloads or overcurrents on each pole current path and an actuator mechanism operated manually by an actuator button. This mechanism includes a permanent magnet lever cooperating with a magnetizable contact operating arm and a magnetizable tripping arm, movement of which is controlled by the protection system. The mechanism also includes a manual actuator for directly opening the power contacts of a overload relay or like device or, after turning the manual actuator button, opening an auxiliary contact to interrupt the current in a coil of a solenoid actuating a contactor/overload relay or like device.

9 Claims, 5 Drawing Sheets

PROTECTION SWITCH DEVICE

CROSS REFERENCE TO RELATED APPLICATIONS

This invention is related to subject matter disclosed in U.S. patent applications Ser. No. 08/254896 entitled "Protection Switch Device," filed Jun. 6, 1994 and Ser. No. 08/394243 entitled "Protective Switch Device," filed Feb. 24, 1995.

BACKGROUND OF THE INVENTION

1. Field of the Invention

The present invention concerns a protection switch device having power poles whose mobile contacts are carried by a contact-holder, a magnetically and/or thermally tripped protection system adapted to detect overloads or overcurrents on each pole current path and an actuator mechanism adapted to be operated manually by an actuator button, this mechanism comprising a permanent magnet lever cooperating with a magnetizable contact operating arm and a magnetizable tripping arm, movement of which is controlled by the protection system.

2. Description of the Prior Art

Protection switch devices include a contact bridge adapted to be moved relative to fixed contacts. In the event of an electrical fault on one pole a magnetic and/or thermal tripping system causes opening of the contacts. This tripping system acts on the contacts through the intermediary of an actuator mechanism which can additionally be operated manually by a manual actuator button.

The contacts of a contactor/overload relay can be operated by manual actuator means, magnetic and/or thermal tripping means for automatic operation in response to a fault and a solenoid for automatic operation under normal conditions. A motor starter comprises similar means for operating the contacts but no solenoid.

Magnetic type actuator mechanisms are described in French patent 1 464 396 and British patent 1 355 035. They include a permanent magnet which cooperates with an armature moved by a tripping device and with an armature fastened to the mobile contact. Movement of the armature associated with the tripping device releases the armature fastened to the mobile contact. A device with more than one pole requires as many magnet mechanisms as these are poles.

An object of the present invention is to provide a magnetic type actuator mechanism which can be fitted to a contactor/overload relay, a motor starter and other, similar protection switch devices. Another object of the invention is to procure sharp opening and closing of the contacts regardless of the device on which the mechanism is mounted.

SUMMARY OF THE INVENTION

The invention consists in a protection switch device having power poles whose mobile contacts are carried by a contact-holder, a magnetically and/or thermally tripped protection system adapted to detect overloads or overcurrents on each pole current path and an actuator mechanism adapted to be operated manually by an actuator button, this mechanism comprising a permanent magnet lever cooperating with a magnetizable contact operating arm and a magnetizable tripping arm, movement of which is controlled by said protection system, wherein said mechanism includes manual actuator means for directly opening the power contacts of a overload relay or like device or, after turning the manual actuator button, opening of an auxiliary contact to interrupt the current in a coil of a solenoid actuating a contactor/overload relay or like device.

In accordance with one feature of the invention, the mechanism comprises a rotatable actuator shaft fastened to the manual actuator button and about which the magnetic lever can pivot, the latter lever cooperating on one side with the trigger arm and on the other side with the contact operating arm.

In accordance with another feature of the invention the actuator shaft is fastened to a swing member coupled elastically to a crank freely rotatable about the actuator shaft and adapted to actuate the coil contact.

In accordance with another feature of the invention the mechanism includes a latch member which can pivot about an axis and has a detent in which a locking peg of the magnetic lever can engage.

Various embodiments of the invention are described in more detail below by way of example and with reference to the appended drawings.

DESCRIPTION OF THE PREFERRED EMBODIMENTS

Figure 1:
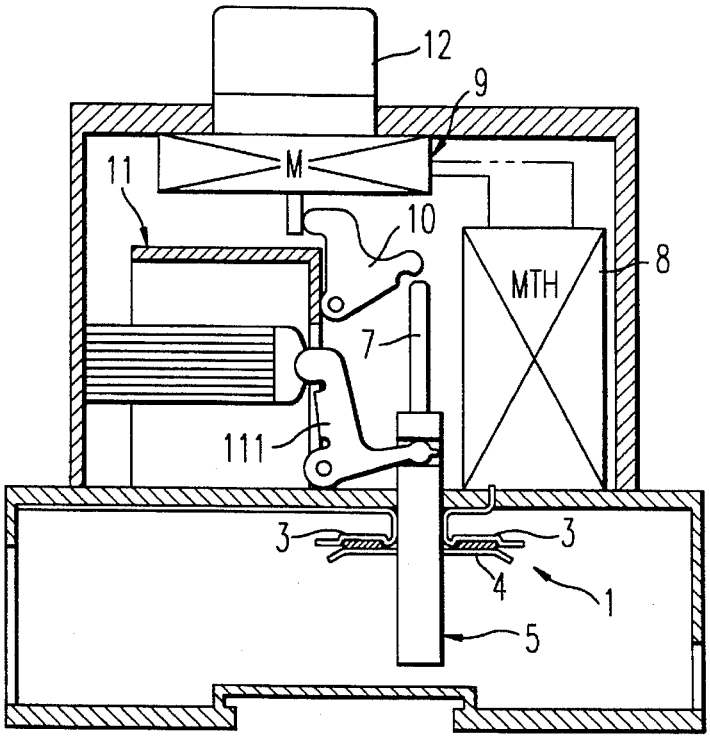
FIG. 1 is a diagram showing a contactor/overload relay fitted with an actuator mechanism of the invention.
Figure 2:
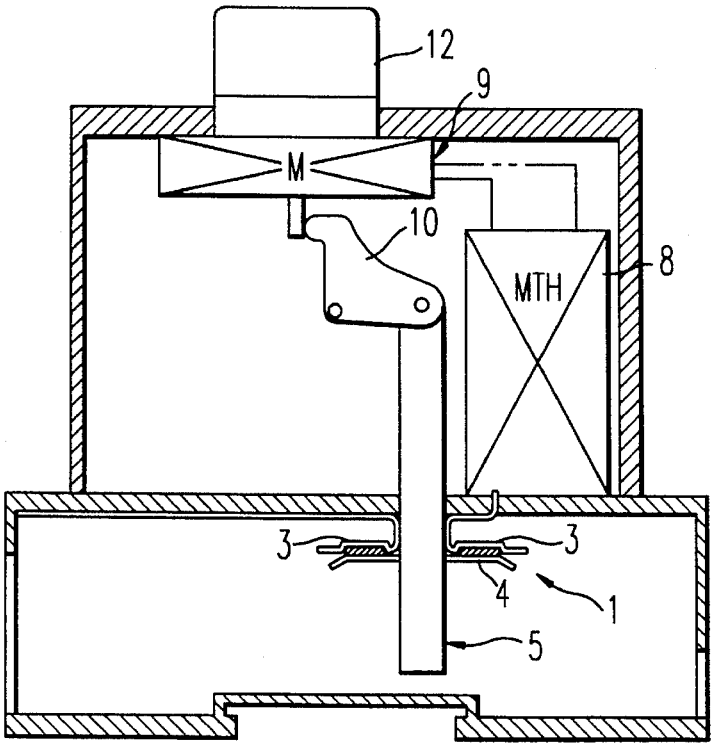
FIG. 2 is a diagram showing a motor starter fitted with an actuator mechanism of the invention.

The actuator mechanism of the invention is designed to be fitted to a protection switch device of the contactor/overload relay type such as that of FIG. 1 or of the motor starter type such as that of FIG. 2.

A device of this kind comprises one or more power poles 1 the fixed and mobile parts of which carrying the separable contacts are associated with conductive paths. The poles are housed in a casing 2.

FIGS. 1 and 2 show a single pole 1 of the double contact type, in order to simplify the drawings. For each pole 1, conductors 3 connect the connecting terminals to the fixed contacts, the associated mobile contacts being carried by a mobile contact bridge 4. The contact bridge 4 cooperates with the fixed contacts to make or break the power current between the connecting terminals.

A contact holder assembly 5 carrying the contact bridges 4 slides in the casing, perpendicular to the plane through the fixed contacts.

A magnetically and/or thermally tripped protection system 8 is housed in the casing to detect overloads or overcurrents on each current path associated with a pole. If the protection system 8 detects an overcurrent or overload on a current path it causes the mobile contacts to open through the intermediary of an actuator mechanism 9 and a swing-arm 10.

In the contactor/overload relay shown in FIG. 1 the contact holder assembly 5 includes a sliding support 6 and sliders 7 guided in this sliding support and each adapted to move in translation a contact bridge 4. A contact pressure spring urges each contact bridge 4 in the contact closing direction relative to the sliding support 6. The swing-arm 10 operates on the slider 7. Note that the coupling between the swing-arm and the slider is a one-way coupling, with the result that the swing-arm does not drive the slider in the closing direction.

A solenoid 11 is housed in the casing 2 to displace the contact holder 5. The solenoid comprises a fixed magnetic circuit, a mobile armature and a coil connected electrically to terminals by separable auxiliary contacts (or coil contacts). The latter can be actuated by the mechanism 9, manually by means of the rotary actuator button 12 or by the protection system 8 in response to a fault. The mobile armature of the solenoid is connected to a return spring and moves a swing-arm 111 directly coupled to the support 6. The return spring of the solenoid thus acts on the contact holder 5. If the coil is de-excited the return spring moves the combination of the mobile armature, the swing-arm 111 and the contact holder assembly 5 to an open (contact open) position.

In the motor starter shown in FIG. 2 the swing-arm 10 is articulated to the upper end of the contact holder 5 in order to drive the contact holder in the opening and closing directions.

FIGS. 3 to 10 show the actuator mechanism 9 in greater detail. It is operated manually by a rotatable actuator button 12 on the front of the casing. The mechanism has two plates fixed to the casing 2 to support the components. The manual actuator button 12 is fastened to an actuator shaft 14 whose rotation is guided by the plates fixed to the casing. The actuator shaft 14 and the actuator button 12 can pivot between three main stable positions: an "on" position (contacts closed), an "off" position (contacts open) and an intermediate "tripped" position (contacts open in response to a fault).

The button 12 is mounted in one of two positions 180° apart depending on whether the mechanism is associated with a contactor/overload relay or a motor starter. It comprises a boss 121 which in a motor starter mode pushes a lever 18 and grooves 122, 123 for guiding a peg 192.

The mechanism 9 comprises a magnetic lever 15 carrying a permanent magnet and two soft magnetic material arms. The magnetic lever 15 pivots on the actuator shaft 14. It cooperates on one side with a tripping arm 16 and on the other side with a contact operating arm 17.

The soft magnetic material tripping arm 16 pivots about an axis 161 relative to the support plates and is acted on by a spring 28. It pivots between an "on" position away from the magnetic lever 15 and a "tripped" position in contact with the magnetic lever.

The tripping arm 16 is held in its "on" position by a locking member 13 which can pivot about an axis 131 in response to tripping of the protection system 8. Once released from the member 13, the arm 16 can be pivoted by the spring 28 into the "tripped" position in contact with the magnetic lever 15.

The displacement of the tripping arm 16 is commanded by the protection system 8. On the occurrence of a fault current the tripping arm 16 can be released from the member 13 by the protection system 8, whereupon it contacts the magnetic lever 15.

The soft magnetic material contact operating arm 17 pivots about the actuator shaft 14. It can pivot between an "on" position in contact with the magnetic lever 15 and in which it is therefore subject to the attraction of the permanent magnet and a "tripped" or "off" position away from the lever 15.

The actuator shaft 14 of the mechanism carrying the rotatable manual actuator button 12 is fastened to a swing member 22. The combination of the swing member 22, the shaft 14 and the actuator button 12 is coupled by a tension spring 23 to a crank 24 which can pivot freely about the actuator shaft 14, between the two positions. The spring 23 is fitted between a finger 221 fastened to the swing member 22 and a finger 241 fastened to the crank 24. The crank 24 can displace a slider 29 carrying a coil contact 252.

The mechanism includes a latch member 20 which can pivot about an axis 201 and which has a bearing surface 202 and a detent 203 in which a locking peg 151 of the lever 15 can engage.

The mechanism includes a lever 18 which pivots about an axis 181. In the motor starter version, pivoting of the lever 18 displaces an intermediate member 21 articulated about an axis 211 and this part 21 operates on the contact operating arm 17. In a contactor/overload relay the lever 18 procures positive opening of the coil contact.

The intermediate member 21 has a bearing surface 212 and is acted on by a spring 213. A spring (not shown) is fitted between the intermediate member 21 and the swing-arm 10.

The mechanism includes a subassembly for re-arming the tripping arm 16. This subassembly comprises (FIG. 6) a re-arming lever 19 which pivots about an axis 153 of the lever 15 and can be rotated about the axis 153 by a peg 192 on which the groove 122 or 123 on the actuator knob 12 acts. A hook 26 is articulated to a plate 27 which can pivot about the shaft 14. The hook 26 retains the peg 192 of the re-arming lever 19. A peg 261 on the hook 26 is guided in a groove of a support plate fixed to the mechanism. This peg 261 controls movement of the hook 26 on displacement of the plate 27, ensuring correct positioning of the peg 192 relative to the button.

The plate 27 is spring-loaded by a spring acting in the direction of the arrow 27F on an attachment point 271.

The operation of the mechanism mounted in a motor starter is described next.

Figure 3:
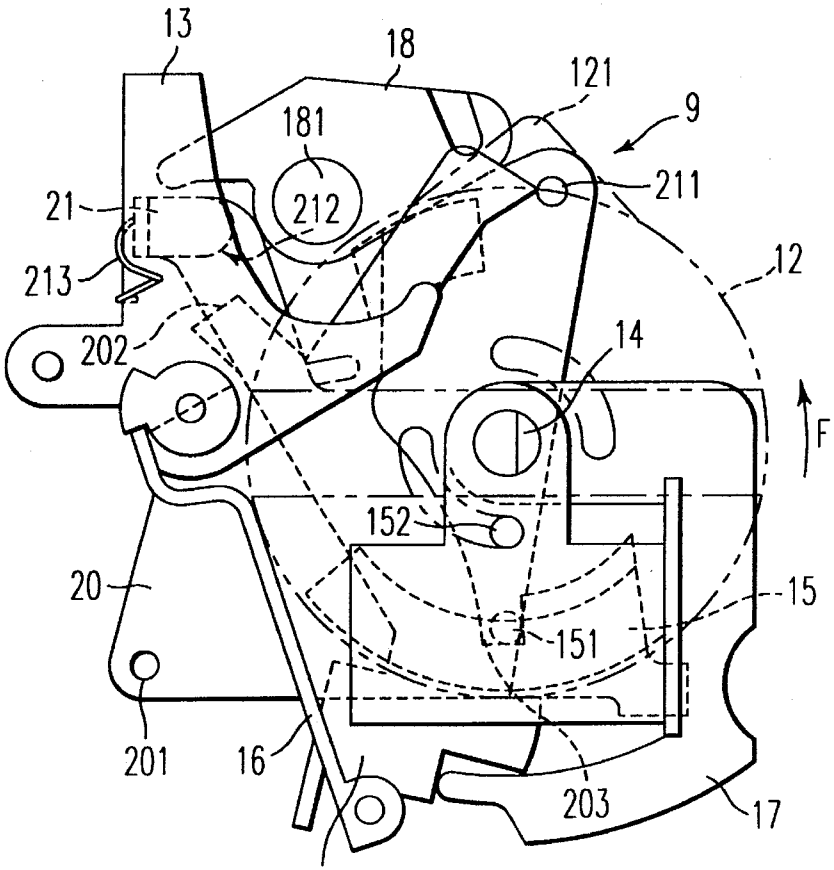
FIG. 3 is a diagram showing the mechanism mounted in a motor starter and in the "on" position.
Figure 6:
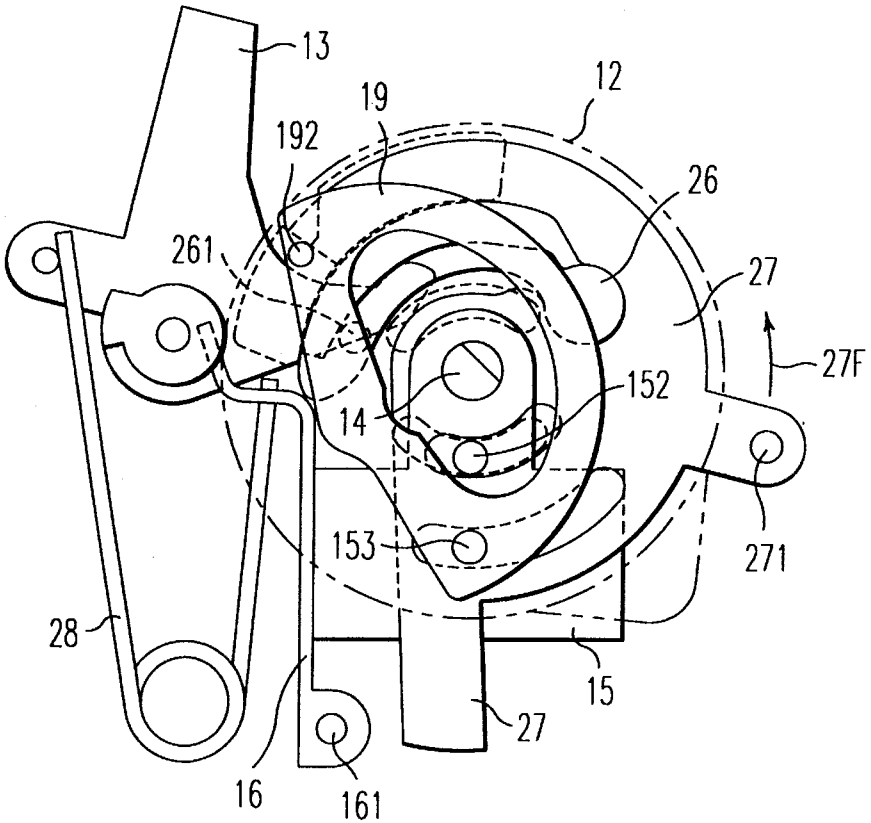
FIG. 6 is a diagram showing park of the mechanism mounted in a contactor/overload relay or a motor starter and in the "tripped" position.

In the "on" position shown in FIG. 3 the magnetic lever 15 is prevented from rotating by its locking peg 151 which is accommodated in the detent of the latch member 20. The flux from the magnet of the magnetic lever 15 is closed in the contact operating arm 17 which is therefore coupled to the lever 15 by a magnetic attraction force. The tripping arm 16 is held in the "on" position by the locking member 13. The mobile contacts are pressed against the fixed contacts (closing the contacts) by application of the member 21 to the swing-arm 10 by the spring 213.

Figure 5:
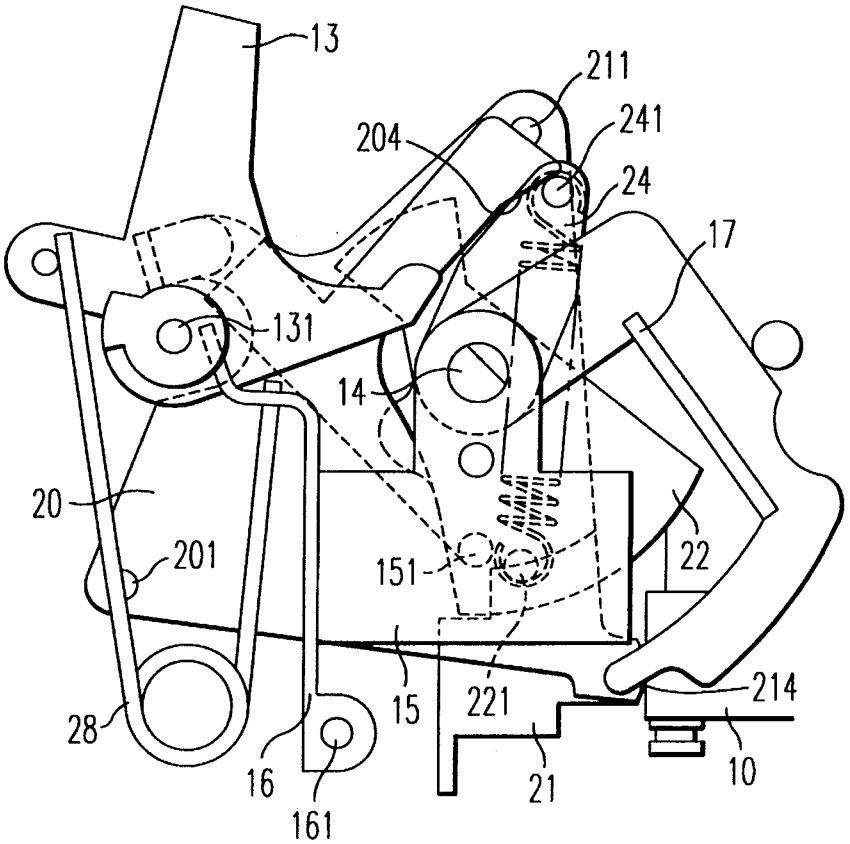
FIG. 5 is a diagram showing the mechanism mounted in a contactor/overload relay or a motor starter and in the "tripped" position.
Figure 8:
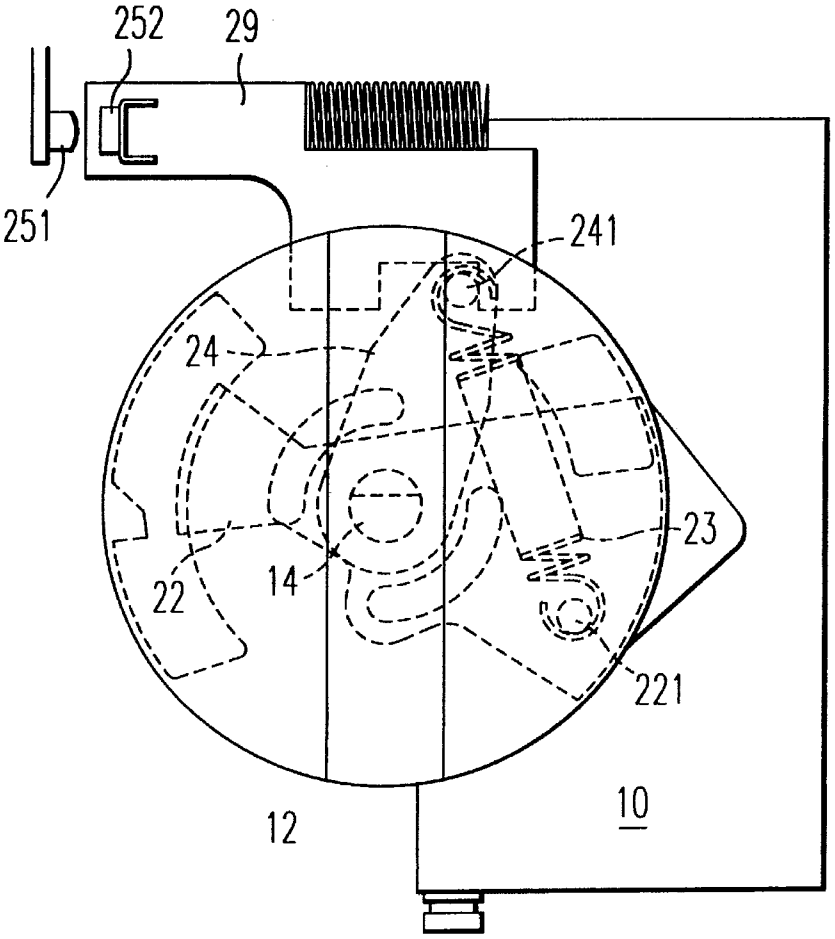
FIG. 8 is a diagram showing the mechanism mounted in a contactor/overload relay and in the "off" position.
Figure 7:
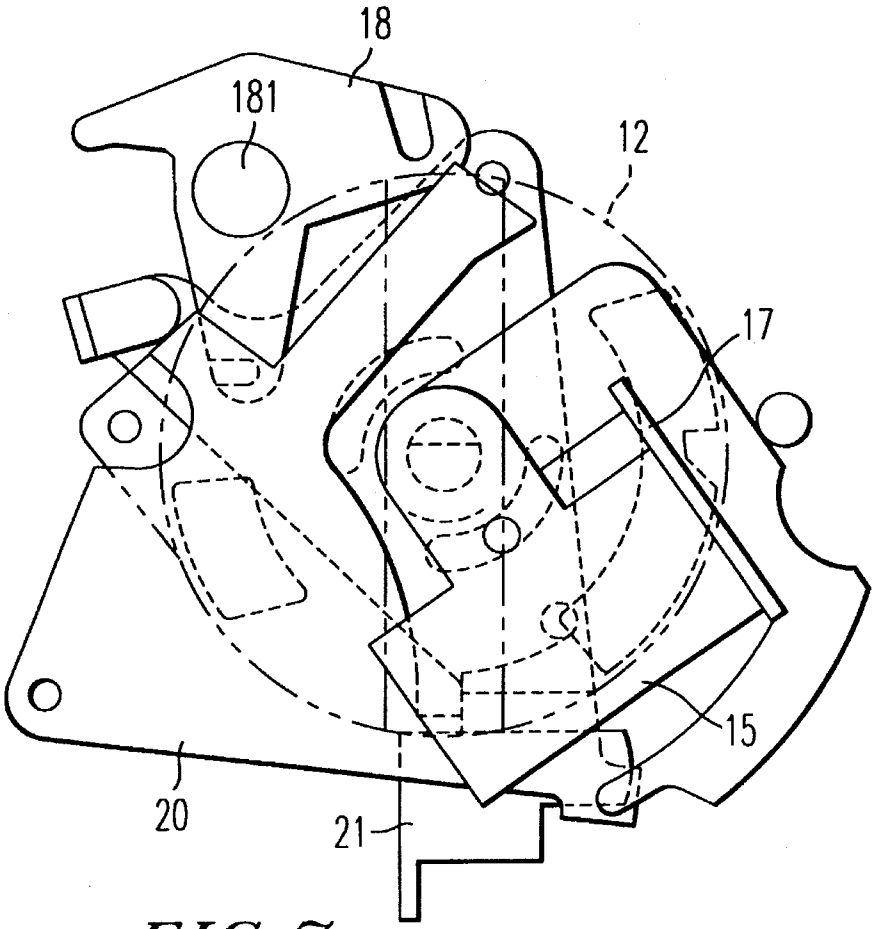
FIG. 7 is a diagram showing the mechanism mounted in a motor starter and in the "off" position.
Figure 10:
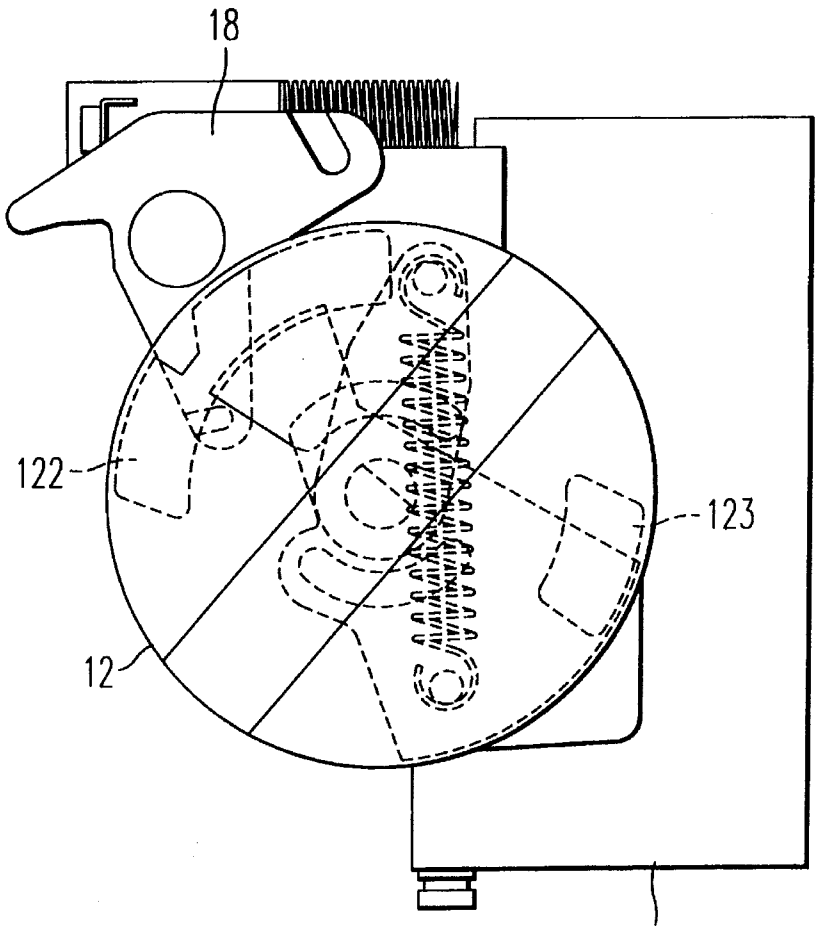
FIG. 10 is a diagram showing the mechanism mounted in a contactor/overload relay and with the coil contacts forced open.
Figure 9:
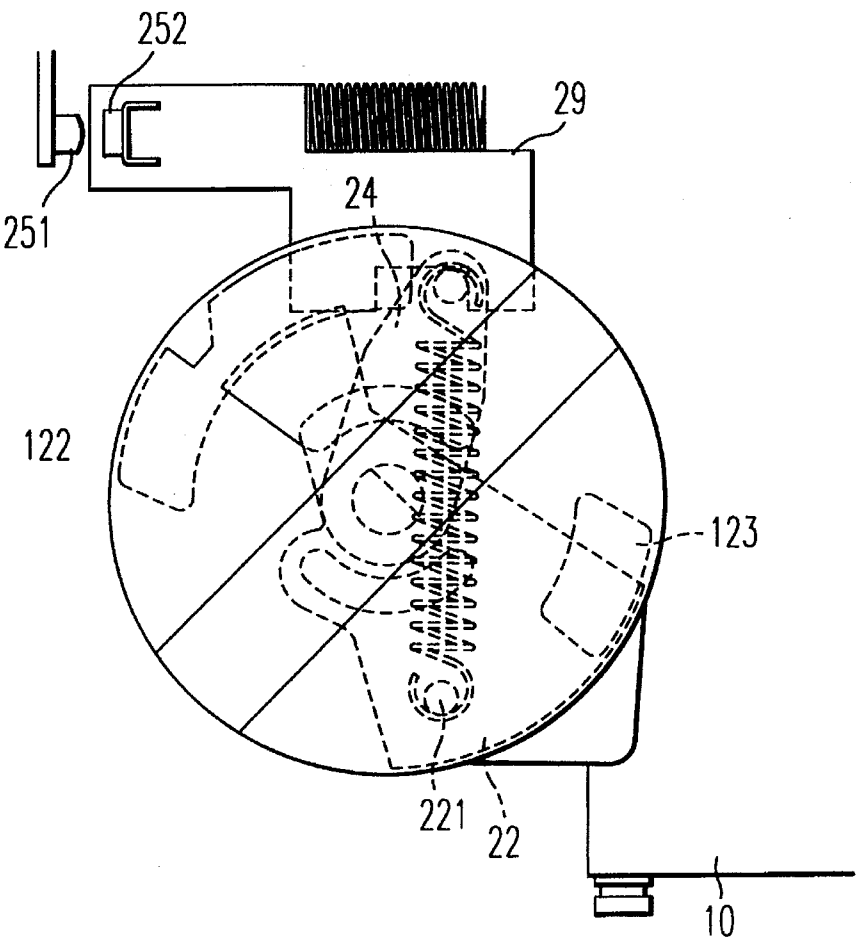
FIG. 9 is a diagram showing the mechanism mounted in a contactor/overload relay and in the "tripped" position.

FIG. 5 explains operation in the case of a fault (overload or short-circuit). The protection system 8 which detected the fault causes the locking member 13 to rotate. This releases the tripping arm 16 which is caused to pivot by the spring 28 and sticks to the magnetic lever 15. The flux produced by the magnet is split between the arms 17 and 16. The force exerted by the magnet on the contact operating arm 17 becomes less than the force exerted on the intermediate member 21 by the spring 213. The released contact operating arm 17 separates from the lever 15, due to the action of the spring 213. In pivoting, the intermediate member 21, by means of a projection 214, pivots the swing-arm 10 which displaces the contact holder assembly 5. The power contacts open.

At the same time, due to the action of the spring 213 the intermediate member 21, or rather its bearing surface 212, strikes the bearing surface 202 of the latch member 20. The latch member 20 releases the magnetic lever 15, which is retained by the tripping arm 16 (FIG. 5).

To switch from the "tripped" position (FIG. 5) to the "off" position (FIG. 7), the actuator button 12 is turned, which applies pressure to the peg 192 and unsticks the magnetic lever 15 from the tripping arm 16. The magnetic lever 15 then picks up the contact operating arm 17 by way of the lever 19. The button 12 causes the re-arming lever 19 to turn, which re-arms the tripping arm 16 on the locking member 13. This re-arming of the tripping arm 16 on the locking member 13 occurs only if the fault has cleared.

To go from the "on" position (FIG. 3) to the "off" position (FIG. 7) the actuator button 12 is turned in the direction F which pivots the tilting lever 18 through the intermediary of the boss 121 which is part of the button 12. The lever 18 causes the intermediate member 21 to pivot. This pushes the contact operating arm 17 away from the magnetic lever 15. The intermediate member 21 is no longer in abutting engagement with the arm 17 and has been released. Due to the action of the spring 213, it pushes the swing arm 10 which moves the contact holder 5 to open the contacts. At the same time the button 12 turns the re-arming lever 19 through the intermediary of the peg 192 to displace the magnetic lever 15 so that it is applied to the contact operating arm 17.

To go from the "off" position (FIG. 7) to the "on" position (3) the manual actuator button 12 is turned which causes the contact operating arm 17 and the magnetic lever 15 to be returned simultaneously by the re-arming lever 19 towards the "on" position shown in FIG. 3. The latch member 20 immobilizes the peg 151 of the magnetic lever 15 in the "on" position.

How the mechanism mounted in a contactor/overload relay works is described next.

Figure 4:
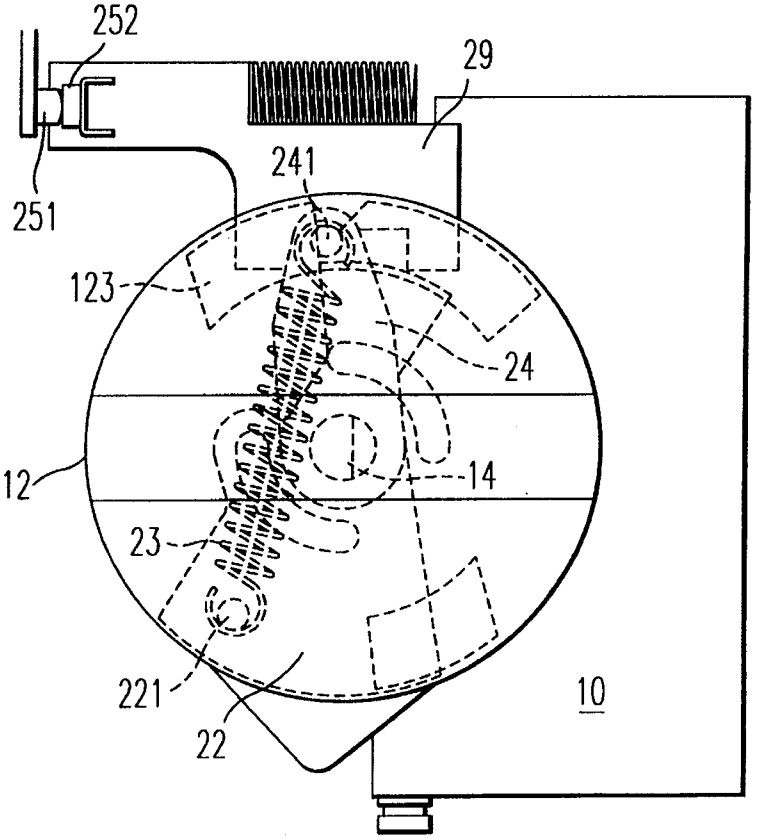
FIG. 4 is a diagram showing the mechanism mounted in a contactor/overload relay and in the "on" position.

The "on" position is the FIG. 3 position, as previously described. Referring to FIG. 4, note that the position of the button 12 is 180° from the position in the motor starter version. Also, referring to FIG. 4, the crank 24, acted on by the spring 23, acts on the slider 29 to close the coil contact 251-252.

In the event of a fault (overload or short-circuit), or on manual opening of the contacts by means of the button 12, the mechanism works in exactly the same way as described above and this results in pivoting of the swing-arm 10 which moves the slider(s) 7. The contacts open.

At the same time the spring 213 causes the bearing surface 212 of the intermediate member 21 to strike the bearing surface 202 of the latch member 20 which releases the magnetic lever 15 held by the arm 16 (FIG. 5). At the same time, the bearing surface 204 of the latch member 20 entrains the peg 241 of the crank 24. The latter pivots about the shaft 14 and entrains the slider 29 which opens the coil contacts 251, 252.

On passing from the "on" position (4) to the "tripped" position (FIGS. 5, 6 and 9), the swing member 22 pivots towards the "tripped" position via top dead center. Opening of the coil contact 251-252 causes the power contacts to be opened. The re-arming lever 19 then determines the position of the swing-arm 22 and the button 12 ("tripped" position). The mechanism therefore opens the power contacts quickly and opens the coil contact in response to an overload or a fault.

To go from the "tripped" position (FIGS. 5 and 6) to the "off" position (FIG. 8) the actuator knob 12 is turned, presses on the peg 192 and frees the magnetic lever 15 from the arm 16. The magnetic lever 15 then picks up the contact operating arm 17 via the lever 19. The button 12 causes the re-arming lever 19 to turn and this re-arms the tripping arm 16 on the locking member 13. This re-arming of the tripping arm 16 on the locking member 13 occurs only if the fault has cleared.

To go from the "off" position (FIG. 8) to the "on" position (FIG. 3) the manual actuator button 12 is turned. This causes the re-arming lever 19 to move the contact operating arm 17 and the magnetic lever 15 simultaneously towards the "on" position shown in FIG. 3. The latch member 20 immobilizes the peg 151 of the magnetic lever 15 in the "on" position and enables the crank 24 to close the coil contacts 251, 252.

It is to be understood that variants of the disclosure and detailed improvements thereto can be envisaged, as can the use of equivalent means, without departing from the scope of the invention.

There is claimed:

1. Protection switch device which comprises:

power poles having mobile contacts carried by a contact-holder, a magnetically and/or thermally tripped protection system detecting overloads or overcurrents on each pole current path and an actuator mechanism operated manually by an actuator button, said actuator mechanism including a permanent magnet lever cooperating with a magnetizable contact operating arm and a magnetizable tripping arm, movement of which is controlled by said protection system, wherein said actuation mechanism includes a manual actuator directly opening power contacts of a overload relay or, after turning the manual actuator button, opening an auxiliary contact to interrupt current in a coil of a solenoid actuating a contactor/overload relay; and a swing arm coupled to said contact holder wherein said actuator mechanism actuates said swing-arm.

2. Device according to claim 1 wherein said actuator mechanism comprises a rotatable actuator shaft fastened to said manual actuator button and about which said magnetic lever is pivotable, said magnetic lever cooperating on one side with said tripping arm and on the other side with said contact operating arm.

3. Device according to claim 1 wherein said actuator shaft is fastened to a swing member elastically coupled to a crank pivotable freely about said actuator shaft and which actuates said coil contact.

4. Device according to claim 1, said magnetic lever having a locking peg wherein said mechanism incudes a latch member pivotable about an axis and having a detent in which said locking peg of said magnetic lever engages.

5. Device according to claim 1 said mechanism incudes a pivotable lever which acts on said contact operating arm or opens said coil contact.

6. Device according to claim 1 wherein said mechanism includes a subassembly for re-arming said opening arm on a locking member.

7. Device according to claim 6 wherein said re-arming subassembly comprises a re-arming lever which is pivotable on said magnetic lever and which is rotated by said actuator button.

8. Device according to claim 6 wherein said re-arming subassembly comprises a pivoting hook.

9. Device according to claim 1, which comprises a return spring, and a solenoid having a mobile armature acted on by said return spring which moves said swing member coupled to said contact holder support.

* * * * *